United States Patent [19]

Tully

[11] 3,963,341

[45] June 15, 1976

[54] COLOR ELECTROPHOTOGRAPHIC PRINTING MACHINE

[75] Inventor: Michael J. Tully, Framingham, Mass.

[73] Assignee: Xerox Corporation, Stamford, Conn.

[22] Filed: Oct. 29, 1974

[21] Appl. No.: 518,542

[52] U.S. Cl. ..... 355/4; 96/1.2

[51] Int. Cl.[2] ..... G03G 15/01; G03G 15/09

[58] Field of Search ..... 355/4; 96/1.2

[56] References Cited

UNITED STATES PATENTS

| | | | |
|---|---|---|---|
| 3,531,195 | 9/1970 | Tanaka et al. | 355/4 |
| 3,563,734 | 2/1971 | Shely | 96/1.4 |
| 3,617,124 | 11/1971 | Haugen et al. | 355/16 |
| 3,643,629 | 2/1972 | Kangas et al. | 118/637 |
| 3,739,749 | 6/1973 | Kangas et al. | 118/637 |
| 3,841,751 | 10/1974 | Draugelis et al. | 355/4 |

FOREIGN PATENTS OR APPLICATIONS

| | | | |
|---|---|---|---|
| 1,293,482 | 10/1972 | United Kingdom | 355/4 |

*Primary Examiner*—Robert P. Greiner
*Attorney, Agent, or Firm*—H. Fleischer; J. J. Ralabate; C. A. Green

[57] ABSTRACT

An electrophotographic printing machine in which successive colored filtered light images expose a photoconductive member recording successive charge patterns thereon. Each charge pattern is developed with single color magnetic particles forming successive single color powder images on the photoconductive member. These single color powder images are transferred, in superimposed registration, to a sheet of support material. The superimposed powder images are permanently affixed to the sheet of support material producing a colored copy of the original document being reproduced by the electrophotographic printing machine.

9 Claims, 3 Drawing Figures

COLOR ELECTROPHOTOGRAPHIC PRINTING MACHINE

The foregoing abstract is neither intended to define the invention disclosed in the specification, nor is it intended to be limiting as to the scope of the invention in any way.

BACKGROUND OF THE INVENTION

This invention relates generally to a color electrophotographic printing machine, and more particularly concerns a chargeless electrophotographic printing machine employing a single component magnetic developer material.

In the process of electrophotographic printing, a photoconductive surface is uniformly charged and exposed to form a light image of an original document. Exposure of the charged photoconductive surface creates an electrostatic latent image corresponding to the original document. A developer mix comprising magnetic carrier granules and toner particles adhering electrostatically thereto is positioned in contact with the electrostatic latent image. The toner particles are electrostatically attracted from the carrier granules to the latent image rendering it visible. Thereafter, the toner powder image is transferred to a sheet of support material and permanently affixed thereto producing a copy of the original document. The foregoing process is described, in detail, in U.S. Pat. No. 2,297,691 issued to Carlson in 1942.

Multi-clor electrophotographic printing is substantially identical to the heretofore discussed process of black and white printing with the following distinctions. Rather than forming a total light image of the original document, the light image is filtered producing a single color light image which is a partial light image of the original document. The foregoing single color light image exposes the charged photoconductive surface to create successive single color electrostatic latent images thereon. The single color electrostatic latent images are developed with toner particles complementary in color thereto. Subsequently, successive single color powder images are transferred to a sheet of support material in superimposed registration with one another. In this manner, a multi-color powder image is formed on the sheet of support material and permanently affixed thereto forming a color copy of the original document.

Various other techniques are employed in electrophotographic printing. By way of example U.S. Pat. No. 3,563,734 issued to Shely in 1971 discloses a photoreceptor which is mounted in the form of an advanceable roll and carriage assembly. The photoreceptor is exposed to a light image of an original document and then advanced past a magnetic brush developer assembly. The magnetic brush developer assembly has magnetic, conductive particles adhering thereto. As the photoreceptor, with the charge pattern recorded thereon, advances past the magnetic brush assembly, the particles adhering thereto contact the charge pattern and are attracted thereto. These particles are then transferred to a sheet of support material secured to a transfer roll. Thereafter, the sheet of support material passes through a fusing device which permanently affixes the powder image thereto forming a black and white copy of the original document.

Other relevant patents which exemplify the foregoing type of system are U.S. Pat. Nos. 3,617,124, 3,643,629, 3,739,749 and 3,764,313. However, none of the foregoing patents appear to disclose the utilization of such a system for multi-color electrophotographic printing.

Accordingly, it is a primary object of the present invention to improve color electrophotographic printing by employing a single component developer material in conjunction with a chargeless system.

SUMMARY OF THE INVENTION

Briefly stated, and in accordance with the present invention, there is provided an electrophotographic printing machine for producing a colored original document on a sheet of support material.

In the present instance, the printing machine includes a photoconductive member and means for exposing the photoconductive member to successive color filtered light images. This records successive charge patterns on the photoconductive member. Each charge pattern corresponds substantially to a discrete color contained in the original document. Developing means deposit single color magnetic particles on the charge pattern. In this manner, successive single color powder images are formed on the photoconductive member. Means are provided for transferring the single color powder image, in superimposed registration, to the sheet of support material. Thereafter, fixing means permanently affix the superimposed powder images to the sheet of support material producing a colored copy of the original document.

BRIEF DESCRIPTION OF THE DRAWINGS

Other objects and advantages of the present invention will become apparent upon reading the following detailed description and upon reference to the drawings, in which.

While the present invention will be described in conjunction with a preferred embodiment and method of use therefore, it will be understood that it is not intended to limit the invention to that embodiment or method of use. On the contrary, it is intended to cover all alternatives, modifications and equivalents as may be included within the spirit and scope of the invention.

DETAILED DESCRIPTION

Figure 1:
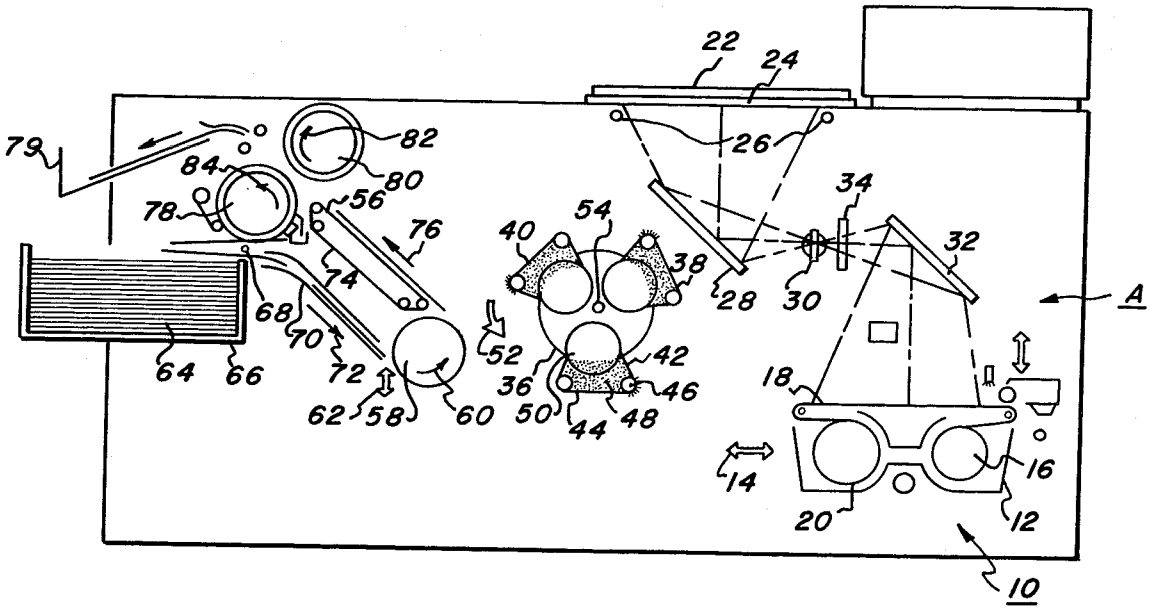
FIG. 1 is a schematic perspective view depicting a color electrophotographic printing machine incorporating the features of the present invention therein.

An electrophotographic printing maachine adapted to form copies from a colored original document is depicted in FIG. 1. The foregoing printing machine will be described, in detail, hereinafter to provide an illustrative example of the printing process employed in the present invention. Continued reference will be had throughout to the drawings. In the drawings, like reference numerals have been used throughout to designate like elements. Although the electrophotographic printing machine of the present invention is particularly well adapted for producing color copies it should become evident from the following discussion that it is equally well suited for producing all types of copies and is not limited to the particular materials and apparatus described herein.

As depicted in FIG. 1, the electrophotographic printing machine employs a photoconductive member, indicated generally by the reference numeral 10. Photoconductive member 10 includes a carriage 12 mounted movably on rails in the printing machine. A rack and pinion drive system or other suitable means are employed to reciprocate carriage 12 in the direction of arrow 14. By way of example, carriage 12 travels at 22 inches per second. A supply spool 16 is mounted rotatably on carriage 12. A flexible belt 18 photoconductive material is entrained about supply spool 16. Flexible belt 18 is also entrained about take-up spool 20. The exposed frames of flexible belt 18 are etrained about take-up spool 20. Take-up spool 20 is spaced from supply spool 15 and is also mounted rotatable in carriage 12. Take-up spool 20 is periodically rotated by an indexing motor (not shown). The indexing motor is actuated by the machine program logic to advance flexible belt 18 the equivalent of one frame prior to the exposure thereof by the next successive filtered light image. Flexible belt 18 may be formed from a conductive layer and panchromatic photoconductive layer with an insulating layer interposed therebetween. The forgoing is discussed more fully with reference to FIG. 2 and 3.

Initially, carriage 12 is positioned at exposure station A. At this time, a full frame of flexible belt 18 is exposed to a filtered light image of original document 22 disposed face down upon transparent viewing platen 24. As shown in FIG. 1, lamps 26 illuminate original document 22. For example, lamps 26 may be a pair of flash lamps triggered at a voltage ranging from about 2100 to 3100 volts. The light rays reflected from original document 22 are directed by mirror 28 through lens 30. Lamps 26 are mounted stationarily and illuminate the entire surface of original document 26 disposed face down upon transparent viewing platen 24. Preferably, lens 30 is a six element, split dagor type of lens having front and back compound lens components with a centrally located diaphragm therebetween. Lens 30 forms a high quality image with a field angle of 31° and a speed of F/4.5 at a 1:1 magnification. The front lens component has three lens elements including, in the following order; a first lens element of positive power, a second lens element of negative power cemented to the first element, and a third lens element of positive power interposed between the second lens element and diaphragm. The back lens component also has three similar components positioned so that lens 22 is symmetrical. Specifically, the first lens element of the front component is a double convex lens, the second element a double concave lens, and the third element a convex concave element. For greater details regarding lens 30, reference is made to U.S. Pat. No. 3,592,531 issued to McCrobie in 1971, the disclosure of which is hereby incorporated into the present application. Interposed between lens 30 and mirror 32 is filter mechanism 34. Filter mechanism 34 includes a housing having a window therein. The window is positioned in the optical light path. The bottom and top walls of the housing member include a plurality of tracks extending the entire width thereof. Each track is adapted to carry a colored filter therein. The number of filters employed in the electrophotographic printing machine is three. One filter is red, another filter being blue, and a third filter being green. The filters are locked into position out of line of the housing window by means of a stop pin which extends up through an opening in the bottom of the housing to the respective track thereof. A solenoid arm is associated with each stop pin. The solenoid arm retains the filter in the inoperative position. A spring is associated with each filter and arranged to move the filter in its track from the inoperative position to the operative position in the housing window. The foreoging occurs, however, only when the stop pin is removed from the track. This occurs upon energization of the respective solenoid which moves the solenoid arm downwardly and retracts the stop pin from the path of the filter. During the first exposure, the green filter is interposed into the optical light path and a green filtered light image is reflected by mirror 32 onto flexible belt 18. This forms a charge pattern corresponding to a single color, i.e. green in the original document. After the charge pattern is developed with particles complementary in color to the light image and the resultant particles are transferred to a sheet of support material, flexible belt 18 is indexed and a fresh frame is positioned so as to be irradiated by the next successive single color image. Thus, in operation, a green filtered light image is projected onto flexible belt 18 recording a green charge pattern thereon. This green charge pattern is developed with magenta particles, i.e. particles complementary in color to the single color light image. After the magenta particles are transferred from the flexible belt to the sheet of support material, the flexible belt is indexed placing the next frame in position for exposure. This frame is then exposed to a red filtered light image which, in turn, is developed with cyan particles. The cyan particles are then transferred to the sheet of support material in superimposed registration with the magenta particles. The flexible belt is then indexed so that a third frame is positioned for exposure to a blue filtered light image. The blue filtered light image is developed with yellow particles and these particles are transferred from the flexible belt to the sheet of support material in superimposed registration with the magenta and cyan particles. Thus, successive frames of flexible belt 18 are exposed successively to green, red and blue filtered light images. The detailed structural configuration of filter mechanism 34 is described in U.S. Pat. No. 3,775,006 issued to Hartman et al. in 1973, the relevant portions of that disclosure being hereby incorporated into the present application.

Referring now to development station B, as shown in FIG. 1, from 36 supports three developer units, 38, 40 and 42, respectively. Frame 36 is mounted rotatably in the printing machine. In operation, the machine logic rotates frame 36 to position the appropriate developer unit in operative communication with the charge pattern recorded on flexible belt 18. Thus, developer unit 38 having yellow particles therein is located adjacent flexible belt 18 when the charge pattern recorded thereon has been produced by a blue light image. Similarly, developer unit 40 having magenta particles therein is disposed adjacent flexible belt 18 when the charge pattern recorded thereon is produced by a green light image. Finally, developer unit 42 having cyan particles therein will be positioned adjacent flexible belt 18 when the charge pattern recorded thereon is produced by a red light image. These developer units are nearly identical to one another, the only distinction being the color of the particles contained therein. Hence, only developer unit 42 will be described in detail. Developer unit 42 includes a housing 44. Housing 44 is totally enclosed with a slit or aperture therein adapted to have a magnetic member or roll 46 positioned thereat. Magnetic conductive particles are disposed in sump 48 of housing 44. Magnetic roll 46 advances these particles into contact with flexible belt 18. Irradiation of the photoconductive layer of belt 18 injects a positive (+) charge in the conductive regions thereof. The positively charged regions do not attract the positively (+) charged magnetic particles from developer roll 46. In the non-irradiated regions of the photoconductive layer, the potential electrically biasing developer roll 46 polarizes the charge on the photoconductive layer creating a negative (−) charge in the vicinity of the surface of the photoconductive layer. The negative charge is sufficient to overcome the magnetic force securing the particles to developer roll 46. The particles are, thus, attracted to the non-irradiated regions of the photoconductive layer. This is a substractive system and requires that the particles be complimentary in color to the color of the filtered light image. In this manner, a single color powder image is placed on flexible belt 18.

Additional particles are added to sump 48 from a storage container 50 mounted internally to housing 48. Developer roll 46 forms a brush of magnetically conductive particles extending about the circumferential periphery thereof. Developer roll 46 is magnetic and attracts the conductive magnetic particles from sump 48 thereto. As developer roll 46 rotates, the brush of developer mix passes into the development zone or slot in housing 44. The brush of charge particles is brought into contact with the charge pattern recorded on flexible belt 18. The forces generated by the charge pattern recorded on flexible belt 18 overcomes the magnetic forces attracting the particles to developer roll 46. In this way, the charge particles are deposited on the charge pattern recorded on flexible belt 18. A grounding roll (not shown) may be employed to reduce the residual voltage in belt 18 to a range of from about 50 to 100 volts D.C. After the charge pattern recorded on flexible belt 18 is developed with the appropiately colored toner particles, carriage 12 advances to transfer station C. Frame 36 is rotated, in the direction of arrow 50, by a suitable indexing motor (not shown) having the drive shaft thereof coupled to shaft 54 of frame 36. The machine logic actuates the indexing motor to rotate frame 36 at the proper time sequence, insuring that the appropriate developer roll is located closely adjacent to belt 18.

After development, carriage 12 is advanced to transfer station C where the powder image adhering to flexible belt 18 is transferred to a sheet of final support material 56. Support material 56 may be a plain sheet of paper or a sheet of thermoplastic material, amongst others. Transfer station C includes a transfer member or drum 58 adapted to rotate in the direction of arrow 60. Transfer drum 58 is adapted to recirculate support material 56 and is electrically biased to a potential of sufficient magnitude and polarity to attract particles from the belt 18 to the sheet of support material. Transfer drum 58 rotates in synchronism with the reciprocating movement of carriage 12. In this manner successive powder images are transferred from belt 18 to support material 56, in superimposed registration with one another. Preferably, transfer drum 58 includes an aluminium tube having at least one layer of urethane secured thereabout. A direct current bias voltage is applied by a suitable voltage source (not shown) to the aluminum shaft by a carbon brush and brass ring assembly (not shown). By way of example, the transfer voltage may range from about 150 to about 450 volts D.C. Transfer drum 58 rotates in synchronism with the reciprocal movement of carriage 12. A flexible metal coupling permits transfer drum 58 to reciprocate, in the direction of arrow 62, so as to enable transfer drum 58 to be moved into contact with belt 18. Prior to proceeding with the remaining processing stations, the sheet feeding path will be briefly described.

A stack of support material 64 is disposed in a tray 66. Feed roll 68 contacts the uppermost sheet of stack and advances the sheet into chute 70, in the direction of arrow 72. Gripper fingers (not shown) mounted to transfer drum 58 secure support material 56 thereon from movement in a recirculating path therewith. After a plurality of powder images (in this case three) have been transferred to support material 56, the gripper fingers space support material 56 from transfer drum 58 permitting it to be separated therefrom. Support material 56, with the multi-layered powdered image thereon, is advanced by endless belt conveyor 74, in the direction of arrow 76, to fusing station D.

At fusing station D, support material 56, with the powder image thereon, passes between fuser roll 80 and back up roll 78. Fuser roll 80 is heated, preferably, to about 390°F. For example, a contact force ranging from about 0.5 to about 3.0 lbs. per linear inch is employed. Back up roll 78 rotates in the direction of arrow 84 and fuser roll 80 rotates in the direction of arrow 82. This type of system is exemplified by U.S. Pat. No. 3,666,247 issued to Banks in 1972, the relevant portions thereof being incorporated into the present application.

After the multi-layered powder image has been permanently affixed to support material 56, support material 56 advances to catch tray 78. At catch tray 78, the machine operator may readily remove the completed color copy from the printing machine.

Figure 2:
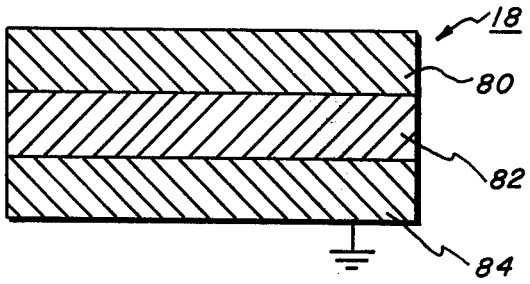
FIG. 2 is a sectional elevational view illustrating schematically the structure of the photoconductive member employed in the FIG. 1 printing machine.
Figure 3:
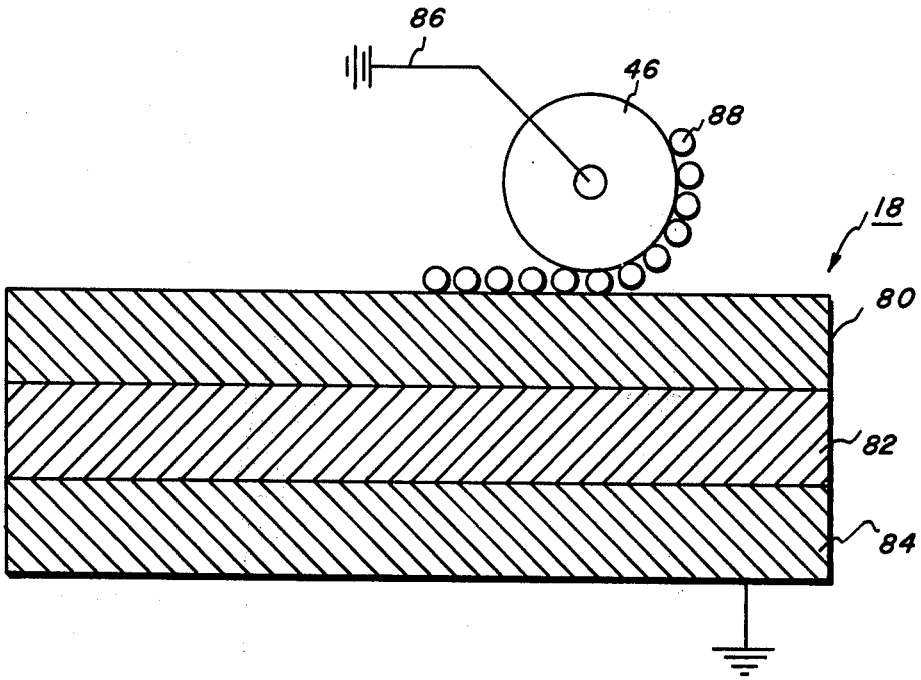
FIG. 3 is a sectional elevational view depicting schematically development of a charge pattern recorded on the FIG. 2 photoconductive member.

Turning now to FIG. 2, flexible belt 18 will be briefly described. Belt 18 acts in a manner similar to the capacitor so as to prevent a discharge path from forming as the electrical bias is applied by the developer roll during the development process. By way of example, layer 80 may be a panchromatic photoconductive layer such as a suitable selenium or titanium dioxide alloy. Preferably, photoconductive layer 80 has a slow dark decay rate so that it will retain the latent conductivity pattern after exposure. A layer of insulating material 82 is secured to photoconductive layer 80. Preferably, insulating layer 82 is made from Mylar. A metal or conductive layer preferably formed from an aluminum vapor coating 84 adheres to insulating layer 82. Thus, flexible belt 18 comprises three layers, a grounded aluminum vapor coating 84, a center insulating layer 82 and a photoconductive layer 80.

After the charge pattern is recorded on belt 18, a single component developer material is deposited thereon. The foregoing is described, in more detail, with reference to FIG. 3. Magnetic developer roll 46 is electrically biased by voltage source 86 to about 800 volts D.C. Magnetic particles 88 adhere to roll 46. Developer roll 46 employs a rotating cylinder and stationary magnetic disposed interiorly thereof. As developer roll 46 rotates, carriage 12 advances flexible belt 18, i.e., photoconductive layer 80, having the charge pattern recorded thereon, so that developer roll 46 deposits particles thereon, in image configuration. The foregoing is repeated for successively differently colored filtered light images which are developed with particles complementary in color thereto. Each of the powder images are transferred to the sheet of support material in superimposed registration with one another forming a multilayered powder image. The detailed structure configuration of the photoconductive member and development process is described in U.S. Pat. No. 3,563,734 issued to Shely in 1971, the disclosure thereof being hereby incorporated into the present application.

In recapitulation, the electrophotographic printing machine hereinbefore described employs a single component magnetic developer material in conjunction with a chargeless system to produce successive single color powder images which are transferred in superimposed registration with one another to a common sheet of support material forming a multi-color copy corresponding to the original document.

It is, therefore, apparent that there has been provided in accordance with the present invention, a color electrophotographic printing machine that fully satisfies the objects, aims and advantages set forth above. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An electrophotographic printing machine for reproducing a colored original document on a sheet of support material including:

a photoconductive member arranged to have a charge pattern recorded thereon without being pre-charged;

means for exposing said photoconductive member to successive color filtered light images to record successive charge patterns thereon, each charge pattern corresponding substantially to a discrete color contained in the original document;

a plurality of magnetic members, each of said magnetic members having differently colored magnetic particles, complementary in color to the filtered light image, adhering thereto;

a frame member mounted rotatably in the printing machine and having said plurality of magnetic members mounted thereon;

means for rotating said frame member to position successive magnetic members closely adjacent to said photoconductive member with the magnetic particles adhering thereto contacting said photoconductive member;

means for transferring, in superimposed registration, successive single color powder images from said photoconductive member to the sheet of support material; and means for permanently affixing the superimposed powder images to the sheet of support material forming a colored copy of the original document.

2. A printing machine as recited in claim 1, wherein said plurality of magnetic members have differently colored magnetic conductive particles adhering thereto.

3. A printing machine as recited in claim 2, wherein said plurality of magnetic members include:

a first magnetic developer roll having yellow particles adhering magnetically to the surface thereof;

a second magnetic developer roll having magenta particles adhering magnetically to the surface thereof; and a third magnetic developer roll having cyan particles adhering magnetically to the surface thereof.

4. A printing machine as recited in claim 3, wherein said photoconductive member includes:

a carriage;

a supply spool mounted rotatably in said carriage;

a take-up spool mounted rotatably in said carriage and spaced from said supply spool;

a flexible sheet entrained about said supply spool and said take-up spool; and means for advancing said flexible sheet from said supply spool to said take-up spool after each successive single color powder image is transferred from said flexible sheet to the sheet of support material.

5. A printing machine as recited in claim 4, wherein said flexible sheet includes:

a panchromatic photoconductive layer;

a conductive layer; and an insulating layer interposed between said conductive layer and said panchromatic photoconductive layer.

6. A printing machine as recited in claim 5, wherein said transferring means includes a rotatably mounted drum having the sheet of support material secured releasably thereto.

7. A printing machine as recited in claim 6, further including means for reciprocating said carriage in synchronism with the rotation of said drum so as to permit successive powder images to be transferred from said flexible sheet to the sheet of support material in superimposed registration with one another.

8. A printing machine as recited in claim 7, wherein said exposing means includes:

a light source for illuminating the original document;

lens means, in a light receiving relationship with the light rays transmitted from the original document, for forming a light image of the original document; and means, interposed between said lens means and said photoconductive member, for filtering the light image to form successive single color light images.

9. A printing machine as recited in claim 8, wherein said fixing means includes means for heating the superimposed powder images transferred to the sheet of support material so as to permanently affix the powder images thereto.

* * * * *